United States Patent [19]

Hayden et al.

[11] Patent Number: 4,833,963

[45] Date of Patent: May 30, 1989

[54] ELECTRONIC MUSICAL INSTRUMENT USING ADDITION OF INDEPENDENT PARTIALS WITH DIGITAL DATA BIT TRUNCATION

[75] Inventors: John A. Hayden, Canton; Robert H. Chidlaw, Westford; Ralph J. Muha, Cambridge, all of Mass.

[73] Assignee: Kurzweil Music Systems, Inc., Waltham, Mass.

[21] Appl. No.: 205,514

[22] Filed: Jun. 7, 1988

Related U.S. Application Data

[63] Continuation of Ser. No. 843,059, Mar. 24, 1986, abandoned.

[51] Int. Cl.[4] ..... G10H 1/04; G10H 1/053; G10H 1/08

[52] U.S. Cl. ..... 84/1.22; 84/1.26; 84/DIG. 10

[58] Field of Search ..... 84/1.01, 1.11–1.13, 84/1.19–1.23, 1.26, DIG. 10

[56] References Cited

U.S. PATENT DOCUMENTS 4,418,600 12/1983 Wachi ..... 84/1.19

*Primary Examiner*—Stanley J. Witkowski
*Attorney, Agent, or Firm*—Jerry Cohen

[57] ABSTRACT

An electronic musical instrument comprising a host processor (10), process/engine interface (12) and sound engine (14) the latter utilizing partial control chip modules (32, 34) and a data path chip module (36) to effect multiple partial (Fourier) synthesis, in conjunction with a sound modelling technique, to generate up to 240 independent partials and impress time-varying amplitude envelopes on them and select and apply them to sound generation, each partial being controlled by selected parameters of frequency, amplitude, phase and attack/decay rate. A modulo-sumdither and oversampling approach to noise reduction is utilized in connection with the data path chip arrangement. Log sine addition is utilized to avoid multiplication apparatus ordinarily required to combine sine wave defining parameters.

1 Claim, 5 Drawing Sheets

ELECTRONIC MUSICAL INSTRUMENT USING ADDITION OF INDEPENDENT PARTIALS WITH DIGITAL DATA BIT TRUNCATION

This is a continuation of application Ser. No. 843,059, filed Mar. 24, 1986 and now abandoned.

BACKGROUND OF THE INVENTION

The present invention relates to electronic means for music generation and more particularly has as its object the provision of such instrument with a sound engine comprising an architecture enabling the application of thousands of stored units of music digital data to rapid production of analog speaker-driving forms, utilizing practical solid state circuit means.

The invention is described below with reference to electronic piano usage, but is also usable in a number of other electronic musical instrument roles to provide, singly or combined, the sounds of a variety of instrument, elements of human voice and other sound sources and in analogous instrument contexts not involving music or voice, but involving comparably varying waveform data.

Multiple Partial (Fourier) Synthesis is a technique well known in engineering practice. Any arbitrary periodic waveform (e.g., musical instruments' sound) may be reproduced by summing up a series of sine waves of appropriately determined frequencies, amplitudes, and relative phases. This technique allows great flexibility, much more so than subtractive synthesis (which starts out with a complex waveform and filters out unwanted spectral content) or wave-table synthesis (which can only reproduce whatever is in the table).

It is the object of the present invention to establish effective instrumentation using Fourier synthesis.

SUMMARY OF THE INVENTION

The musical apparatus of the invention inputs a stream of digital signals which represent a sequence of audio notes to be ultimately produced. The apparatus creates a sequential list of partials and impresses time-varying amplitude envelopes on them, such that the sequential list completely characterizes the desired audio signal. A multiple partial synthesis, sometimes referred to as a Fourier Synthesis, is formed.

Each partial from the sequential list is digitally generated by stepping through a ROM containing a single cycle forming the frequency of that partial and combining it with the amplitude envelope for that partial resulting in a signal with the desired frequency, amplitude, duration and attack and decay rates. All the partials are summed into a digital data stream which is converted to an analog form, filtered and made available for use, for example by an audio amplifier and speakers producing sound.

With reference to the preferred embodiment a sine wave is digitally stored and sensed at an appropriate rate of change of phase angle per sample frequency of a given partial. The phase angle determines the next value selected from the stored sine wave so that changing the rate of change of the phase angle changes the resulting frequency. The stored amplitude is scanned synchronously with the sine wave scanning in a pipe line design ensuring the proper time relationship between the two. Since a partial is a waveform multiplied by an amplitude, both are stored in log form, then added and the anti-log generated forming the resultant partial as a digital stream of signals.

The technique has many useful properties. One is that the quality of a given sound increases as more partials are used to represent it. Another is that partials are controlled independently of one another. This feature allows less important partials to be "stolen" from notes already sounding, and used to form new notes. Taken together, these two properties allow both the ability to play many complex timbres simultaneously, as well as allowing enhanced quality for notes played singly or in some instances against a demanding background of silence. This is in contrast to many commercially available synthesizers, which allow only a limited number of voices. The latter force entire previously played notes to be silenced as more notes are played (e.g., a 10-note chord played on an 8-voice synthesizer).

Additionally, multiple partial synthesis can be used with sound modelling data stored in one or more read only memories to lower the cost of extra installed voices, because of the greatly reduced storage requirements that go with partials-synthesis. One second of waveform table as in conventional wave table storage may be tens of Kilobytes, whereas the information that describes a sound and the 10 to 50 partials needed to synthesize the same sound with the present invention would be smaller by a factor of up to 20. Similarly, having several voices available at once for a keyboard split or orchestral effect is much less expensive.

The sound model data comprises, in accordance with the invention, the amplitude envelope for each partial as a series of exponential "segments" stored in ROM. Segments have the properties of duration (time) and rate/-direction of change (attack/decay). During each segment, the amplitude of a given partial increases or decreases exponentially at a fixed rate maintained by the hardware of what is described herein as a sound engine. Thus, all the processor of such engine has to do is update the rate of change of amplitude for each partial after the apropriate duration, starting the next segment.

The invention allows maintenance of a far greater number of accurate models for sounds available at all times compared to prior art capability. A digital model of the sound generation process is calculated in real time, as opposed to playing out a sample table. Each note on each pitch of each voice can be modeled separately, to any required accuracy, if so desired.

The "engine" comprises the hardware in VLSI and or TTL and/or other integrated and modular versions to synthesize, control, and sum up a number of sine waves. It can generate (in a typical configuration) up to 240 independent partials, and additionally can impress time-varying amplitude envelopes upon them. These partials can be put together in any combination, producing 10 different sounds that each require 24 partials, one sound of 236 partials and 2 sounds of 118, or any other arbitrary combination.

Each partial is controlled by four parameters: frequency, amplitude, phase, and attack/decay rate. All these parameters are made available to the programmer, and are described in detail below.

Generation of each partial is handled by stepping a pointer through a ROM containing a quarter cycle of a sine wave. This pointer is maintained automatically for each partial by one of two partial control chips, each of which contains storage for 240 16-bit phase pointers and 240 16-bit frequency control values (one of each per partial). Each partial's phase pointer is incremented by the frequency control value one per sample cycle, and the resulting new pointer is handed to a data path chip (DPC) for processing. Thus, the larger the frequency constant, the fewer cycles required to step through the sine wave ROM and the higher the resultant frequency.

Amplitude envelope generation is handled in a VLSI version of the invention by a partial control chip (PPC). The PCC contains RAM arrays for the 240 current amplitude values and the 240 attack/decay increments. Values for the current amplitude of each partial are derived in a similar manner to that used for the phase pointers, and handed to the DPC for processing.

The DPC takes in the phase and amplitude values in a pipelined stream, and uses the phase pointer to look up the value of the sine wave for that partial (stored in an internal sine wave ROM table herein). It then scales the value of the sine for that partial by the amplitude value (functionally performing a multiplication). It also accumulates all 240 partials into the final output sample, and provides stable data to a digital to analog converter for conversion via its sample bus.

A host processor maintains control over all this by creating and maintaining a model of the sound desired, and modifying the frequency, attack/decay rate, amplitude, and phase of each partial required, all in real time.

The use of phase angle and frequency information in address form facilitates generating log-sine functions through a look-up table (avoiding use of logarithmic conversion circuitry of analog or digital form and providing an inherently fast, clean source of the data). Relevant prior art includes the article of Snell, "Design of Digital Oscillator Which Will Generate Up To 256 Low Distortion Sine Waves In Real Time," Computer Music Journal, pp. 4–25 (April, 1977). Snell provides—in electronic musical instrument context—slope and data phase angle RAM's which yield digital information, an adder thereof, a phase angle RAM determining stored sine wave scan parameters, addition of the phase and slope/delta phase, all with feedback essentially as described for corresponding components of the present instrument. Also, Snell provides a sine wave look up table (but not log-sine information).

Amplitude information is multiplied by the sine wave information—rather than providing an adding of logs as taught herein. The product of such multiplication comprises the partials information which is used (typically as 28 bit words) for later truncation (to 16 bit words) and then provision to a holding register, DAC's and music output elements. There is no correction or accuracy enhancement of the rounding.

Parks, "Hardware Design Of A Digital Synthesizer," Computer Music Journal, pp. 44–16 (Spring, 1983), shows usage of a log look-up table for sine wave frequency (in effect, phase angle as well) information and the resultant elimination of multiplier circuits. The system context of Parks is a pipelined architecture differing from the system context of the present invention.

The present invention is also characterized by the above described dedicated logic of the sound engine. This affords separation of engine functions from other musical instrument functions and minimizes timing, hardware and software constraints of multi-use logic/-RAM elements.

Other objects, features, and advantages will be apparent from the following detailed description of preferred embodiments thereof taken in conjunction with the accompanying drawing, in which:

BRIEF DESCRIPTION OF THE DRAWING

FIGS. 10–14 show a TTL hardware-simplified embodiment, incorporating complex system approaches to enable hardware simplification consistent with performance values.

DETAILED DESCRIPTION OF PREFERRED EMBODIMENTS

Figure 1:
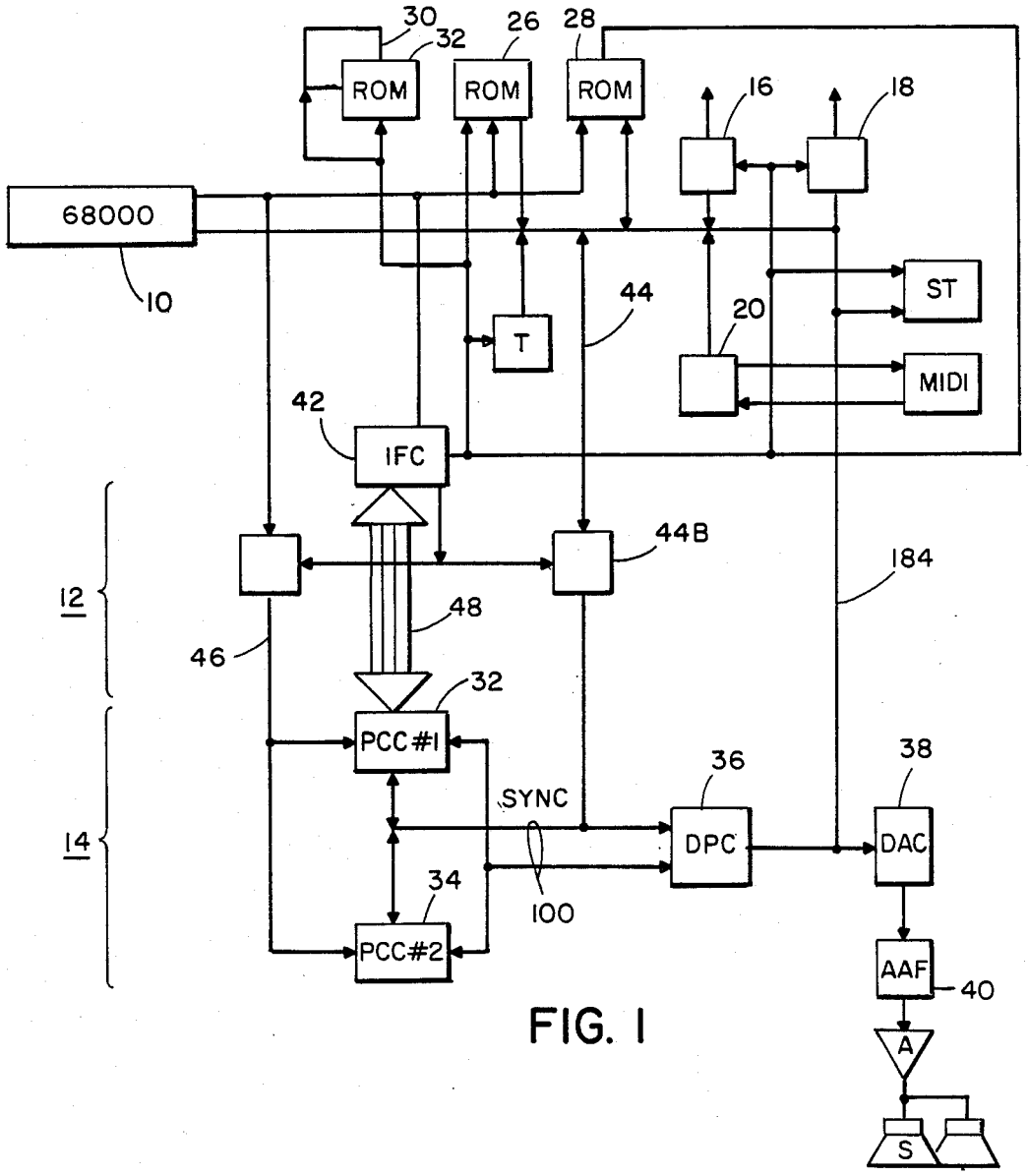
FIG. 1 is a block diagram representation of a preferred embodiment of the invention preferably of VLSI construction.

FIG. 1 shows in block diagram form, the apparatus of a preferred embodiment of the invention. Such apparatus comprises a the host processor 10 which handles input signals representing one or more selected parameters (such as notes being played) from a keyboard port 16, front panel port 18, and/or the musical instrument digital interface (MIDI) link 20, and creates a list of notes. The apparatus then processes these notes using information contained in an internal sound modelling ROM 12 (which may be supplemented by one or more external complementary ROM(s) 30 of the same type), to produce the list of partials required to produce the sounds requested by the player. These partials are then allocated from an available pool of 240. Amplitude envelopes are also produced by the host processor 10 according to the list of envelope segments also contained in ROM 22 (or 30). Durations for each segment are timed by an event timer module 24 and attack-/decay rates are handled automatically by the engine 14, for the duration of each note. By judicious use of this automatic envelope generation feature, host processor 10 overhead can be minimized. At the end of the note, all partials are returned to the pool.

The host processor 10 directly controls three memory arrays. These are the program ROM 26, the sound modelling ROM 22, and scratchpad RAM 28 which provide for multiply, typically 7–8 basic voices (e.g., a grand piano, Rhodes, B3, and other instruments). The additional sound modelling ROM(s) 30 can be added in interchangeable modules, allowing additional voices for the instrument.

Scratchpad RAM 28 is divided up into two parts: a nonvolatile RAM (battery backup) for storing keyboard and panel setups, and a scratchpad RAM which may also have battery backup.

Resident ROM 26 typically comprises sixty four kbytes of stored data for sound modelling use, to support the installed voices, and thirty two K-bytes for program use. All peripherals are memory mapped.

Functionally, the operating software of the apparatus has five basic tasks to address. First, it must service requests for notes to be played, whether received from the keyboard 16 or the MIDI link 20. Secondly, it must assemble (from the currently selected sound model resident in the host processor's sound moddeling ROM)

a list of partials and their associated amplitude envelopes necessary to create that note. Third, it must allocate these partials from the engine's 14 free pool of 240, diverting partials from other notes whose decays have nearly finished if need be. This is accomplished by writing the appropriate data in the partial descriptors maintained in the engine parameter store. Fourth, it must then maintain the envelopes for all current partials by updating the attack/decay values in real time, as required by the currently selected notes. It is aided in this task by the event timer 14, allowing it to set up an interrupt for the host processor 10 for some future time. Finally, it provides for self-test functions.

Data flows are over a data bus 44 with appropriate buffers (e.g. 44B, interface chip 42, or other interface equipment) sample data line 184, read/write address line 46.

The engine 14 constitutes a dedicated high-speed digital additive synthesizer, which automates the processes of sine-wave generation, scaling, and envelope generation, allowing high performance with minimal host processor intervention and minimum cost. The engine is made up of two partial control (PCC) VLSI chips 32, 33 one data path VLSI chip (DPC) 36 and a 16-bit linear digital to analog converter (DAC) 38 (typically a Burr-Brown PCM 53JPV 16-bit DAC) and its associated analog filter circuitry 40—specifically an anti-alias or anti-image filter comprising typically a ninth order low pass filter.

The engine produces a 16-bit sound sample once overy 51.2, uS, for an overall sample rate of 19.53125 KHz. This allows, approximately, an 8.4 KHz output bandwidth after anti-image filtering. The engine produces each sample by summing up the values of 240 partials, each of which is a separate sampled sine wave of arbitrarily programmable frequency, magnitude, and relative phase. The four coefficients required to control each of these partials are stored in the logical engine parameter store, which is mapped into RAM arrays contained in the two PPCs by the interface chip (IFC) 42.

Wave generation is handled by stepping a pointer through a ROM containing a single quarter-cycle of a sine wave. This pointer is maintained automatically for each partial by PCC 32 which will hereafter be referred to as the Phase PCC. It contains RAM arrays which accomodate the 240 16-bit phase pointers and the 240 16-bit frequency control values. Each partial's phase pointer is incremented by the frequency control value once per sample cycle, and the resulting new pointer is handled to the DPC for processing. A pointer is used to facilitate a table look up in the DPC as noted below. Thus, the larger the frequency constant, the fewer cycles required to step through the sine wave ROM and the higher the resultant frequency.

Amplitude envelope generation is handled by PCC #2, i.e. item 34, also referred to as the Amplitude PCC. The Amplitude PCC 34 contains RAM arrays for the 240 current amplitude values and the 240 attack/decay increments. Values for the current amplitude of each partial are derived in a similar manner to that used for the phase pointers, and handed to the DPC for processing.

The DPC 36 takes in the phase and amplitude values, and performs the sine wave lookup and scaling functions on each partial. It also accumulates the final output sample, and provides stable data to the DAC 38 for conversion via its sample bus.

Figure 2:
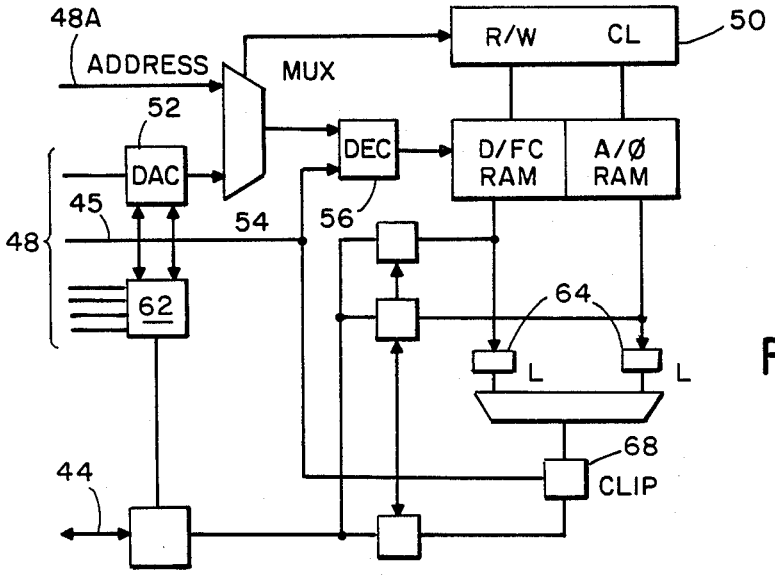
FIGS. 2–4 and 6–9 are similar block diagrams of component portions of the FIG. 1 apparatus—respectively, data path chip (2), data path chip (3), log sine generator (4), inverse log generator (6), modulo-sum-dither (7–8), and pitch processor (9); including pitch-processor system schematic diagrams of hardware arrangement and multi-bit structure for a pitch value (8*a*, 8*b*, respectively).

FIG. 2 shows a PCC chip in detail. Each PCC 32, 34 has as input the bidirectional engine data bus 44, the buffered host processor address bus 46 (see FIG. 1), and the interface control signals 48 (including interface handshaking and global synch) and address bus 48A. The master/slave pin 45 allows the PCC to be tailored for the different jobs when master Phase PCC and when slave Amplitude PCC. Each contains two times 240 (i.e. 480) 16-bit words of RAM (58, 60) address multiplexing 54 and decoding logic 56, a 16-bit adder 66, a programmable arithmetic clipper network 68 at the adder's output and control logic 62. They also contain a partial (sync address counter) section 52, used to maintain synchronization between both PCCs and the DPC.

When in the master mode the PCC functions as the wave generator by enabling the RAM 58 to contain the frequency data, and RAM 60 to contain the phase data. Correspondingly in the slave mode RAM 58 contains the attack/decay, and RAM 60 the amplitude information. The arithmetic clipper is allowed to wrap around when overflowing or underflowing during wave generation since wave generation is cyclical containing positive and negative values. However, during amplitude generation the clipper 68 is constrained to stop at its maximum count (FFFF in hex notation) and at its minimum count (0000 in hex notation) The DPC 38 is responsible for taking in the phase and amplitude information generated for each partial by the PCCs, performing the sine wave lookup and scaling required, accumulating the final sixteen-bit sample, and presenting it to the DAC 38. It inputs the data from PCC 32 and PCC 34 bus and a SYNC signal from PCC 32 which synchronizes the engine 14, and produces a data result containing all the audio information desired by the player. Due to the nature of the processing that it performs, it is a highly pipelined configuration.

Normally, the process of scaling a given partial value by an amplitude value requires a multiplication. However, due to the cost and complexity of performing a fast sixteen bit by sixteen bit multiplication these operations occur in the log-base two domain. Here, the multiply becomes an add, followed by a lookup in an antilog table. The data provided by the Amplitude PCC 34 is also in the log-base two domain, which yields piecewise-exponential envelopes. This is preferable, as the human hearing mechanism is logarithmic in nature.

Figure 3:
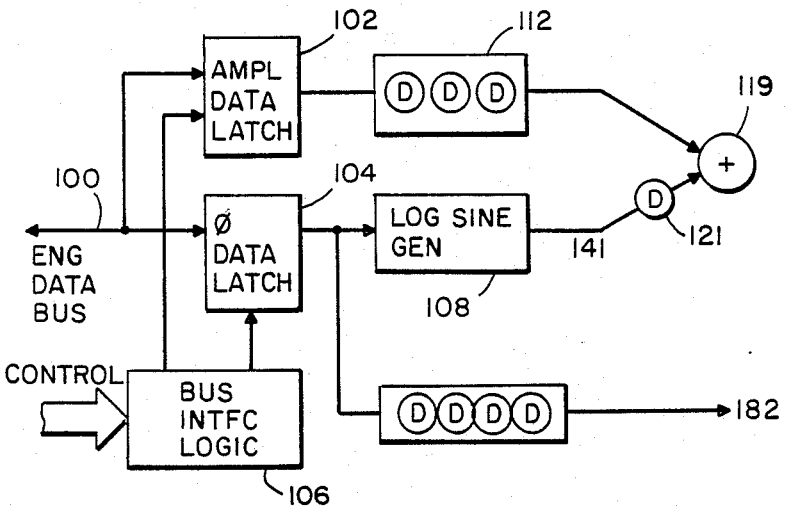

FIG. 3 shows the DPC 36 in detail. Phase data is input via the engine data bus 100 and latched in the phase data latch 104. Since the phase data, as noted above, as in the log-base two conversion is accomplished by a look up table for the log in logsine ROM 108. The phase data is used as a pointer or address. The amplitude data also is input via the engine data bus 100 and latched in the amplitude data latch 102. After the log-base two conversion is complete the amplitude value and the phase value, both in log-base two form are input to the adder 119. The added logarithms represent the linear multiplication of amplitude and waveform discussed previously. Since the DPC is a pipelined design it is required that the amplitude and waveform information are added in synchronism, requiring that the clocking delays in the path from the amplitude data latch 102 and the phase data latch 104 be equal. Between the amplitude data latch 102 and the adder 119 there are three clock delay latches 112. There are three clock delay latch equivalents from the phase latch 104 to the adder 119 through the log sine generator 108.

Figure 9:
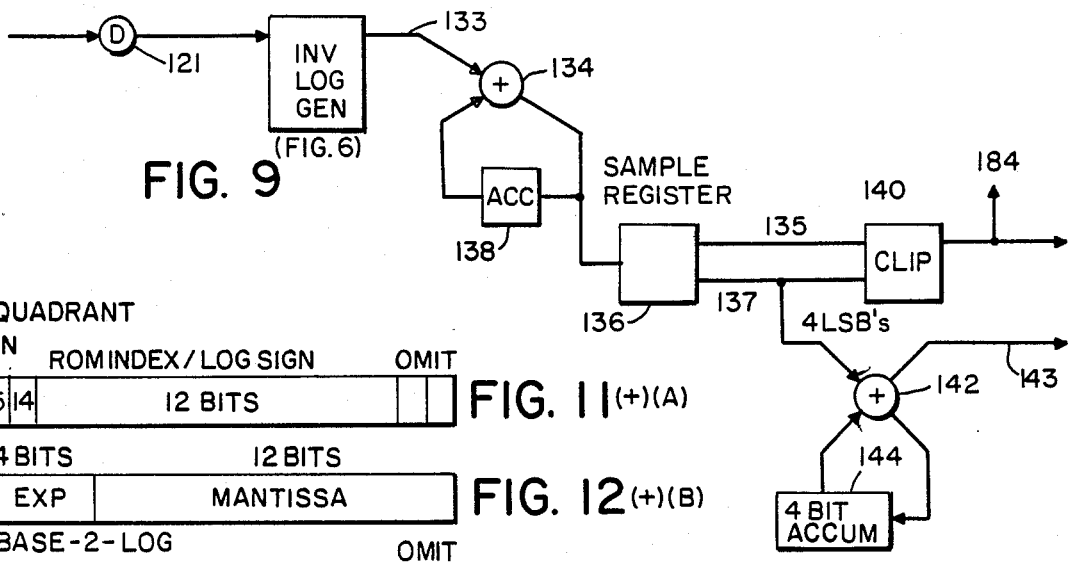
Figure 14:
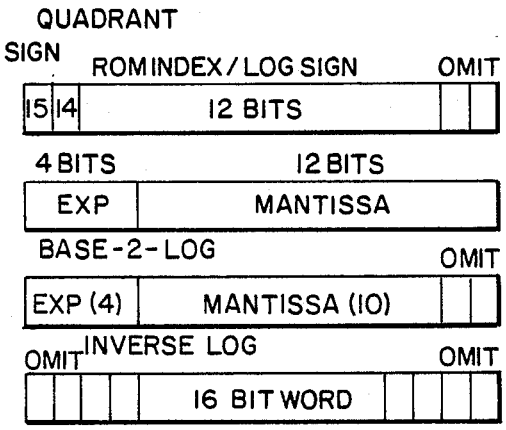

In the log sine generator (shown in FIG. 4), storage locations are reduced by exploiting the symmetry of a sine wave. The sine wave portion from 0° to 180° is identical to the portion from 180° to 360° bit for the sign. Hence, the most significant bits of the sixteen-bit output from the phase data latch 104 are sent directly to the scaling shift comparator 132, shown in FIG. 6, to control the sign of the resulting waveform. For the purposes of this description the most significant bit (MSB) is bit 15 and the least significant bit is 0. The MSB travels through eight clock delay latches 122,146 (shown in FIG. 9), to maintain synchronism with the other conversions.

The sine wave symmetry from 0° to 180° is also exploited to reduce storage required. Here the sine wave from 0° to 90° is a mirror image of the portion from 90° to 180°. The result is that only ¼ of the sine wave need be stored. The values stored are calculated by dividing the 0°-90° range into, typically, 4096 parts and storing in the ROM the sine function at each interval's center.

Figure 5:
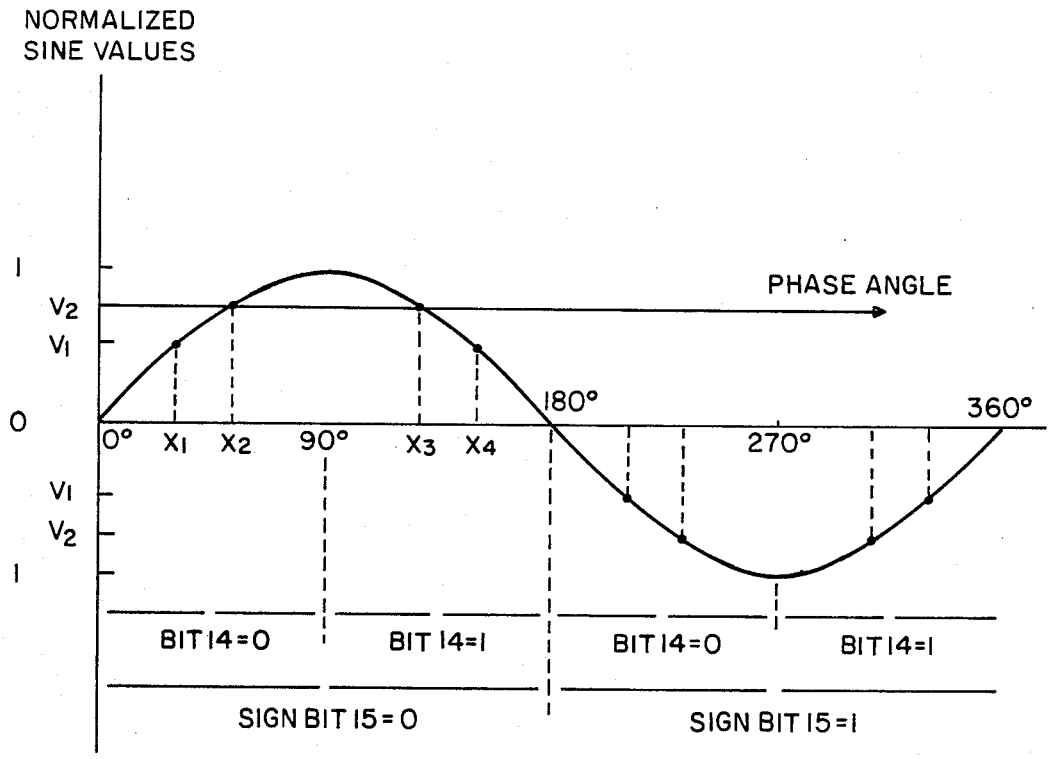
FIG. 5 is a sine-wave graph form showing normalized sine values-phase angle correlation utilized in connection with the FIG. 4/6 components.
Figure 7:
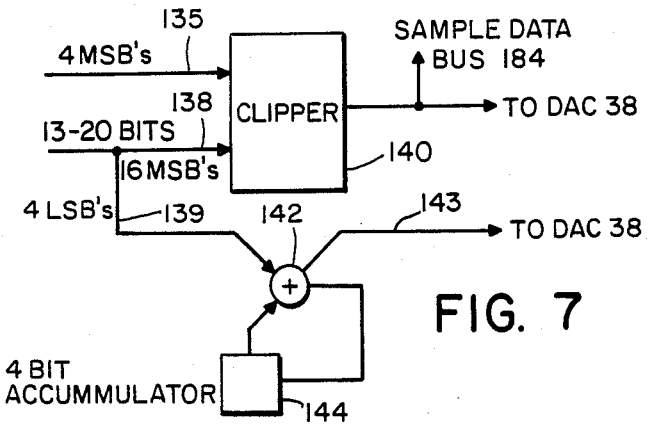

FIG. 5 illustrates this process. Starting at 0° the sine 0°=0, as the sine wave is traversed from 0° to 90° the values $V_1$, $V_2$ and 1 are generated for the phase angles $X_1$, $X_2$, 3 and 90°, respectively. Now as the sine wave is traversed from 90° to $X_3$, $X_4$, and finally 180° bit 14 through the OR array 107 causes in effect the sine wave to be traversed from 90° back to 0° and the values $V_2$, $V_1$and 0, are generated for the phase angles $X_3$, $X_4$, and 0, which are the correct values due to the mirror image summetry of the sine wave from 0° to 90° and 90° to 180°. The MSB, bit 15, of the data from the phase data latch 104, provides the negative sign as the sine wave is traversed from 180° to 360° and bit 14 controls the generation from 180° to 270°, and then bit 14 reverses the generation from 270° to 360°. The result is that only ¼ of sine wave is stored in ROM.

Figure 4:
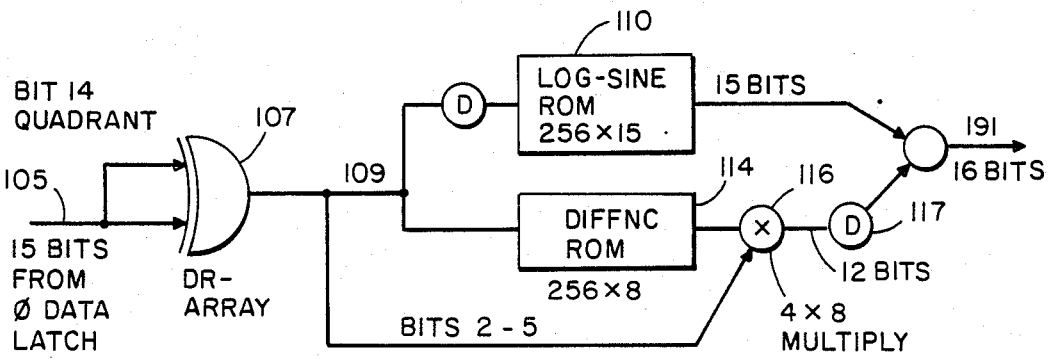

FIG. 4 shows in detail the log sine generator 108. Only fifteen bits are input to an exclusive OR array 107. Bit "14", called the quadrature bit since it determines which quadrant 0° to 90° or 90+ to 180° is being used to generate the log sine wave. The operation of the OR array 107 and bit 14 is to reverse the order of the access to the stored values in the ROM 110 and the difference ROM 114.

The actual values for the sine wave stored in two read only memories, log sine ROM 110 and difference ROM 114. Both these ROM's are addressed by the most significant eight bits from the OR-array 104, so each has 256 locations. The log sine ROM 110 contains values, each fifteen bits, representing 256 positions of a sine wave from 0° to 90°. The difference ROM 114 contains values, each eight bits, representing the difference between successive values from the log sine ROM 110. The value from the difference ROM 114 is multiplied by the bits "2", "3", "4", and "5" from the OR-array 107 by the parallel multiplier 116 producing a twelve bit product. The effect is to scale the difference value by the least significant bits from the OR-array 107, thereby generating an interpolation between values in the log sine ROM 110. This scaled difference value output from the parallel multiplier 116 is delayed by the clock delay latch 117 to synchronize it with the delay of the data through the clock delay latch 109 and the log sine ROM 110. The scaled difference is then added to the value from the log sine ROM by adder 118 resulting in a sixteen bit value which is delayed by the clock delay latch 121, again for synchronization, and is added to the amplitude data by adder 119. The effect of the configuration shown in FIG. 4 provides values for producing a sine wave with a resolution approaching that achieved by a single 4096 word by sixteen bit ROM.

The clip network 120 causes overflow to be clamped at FFF in hex notation if overflow occurs.

The inverse log function is formed similarly to the formation of the log sine shown in FIG. 5. The sixteen-bit value from the clip network 120 is delayed by the clock delay latch 121 and input to the inverse log ROM 125.

Figure 6:
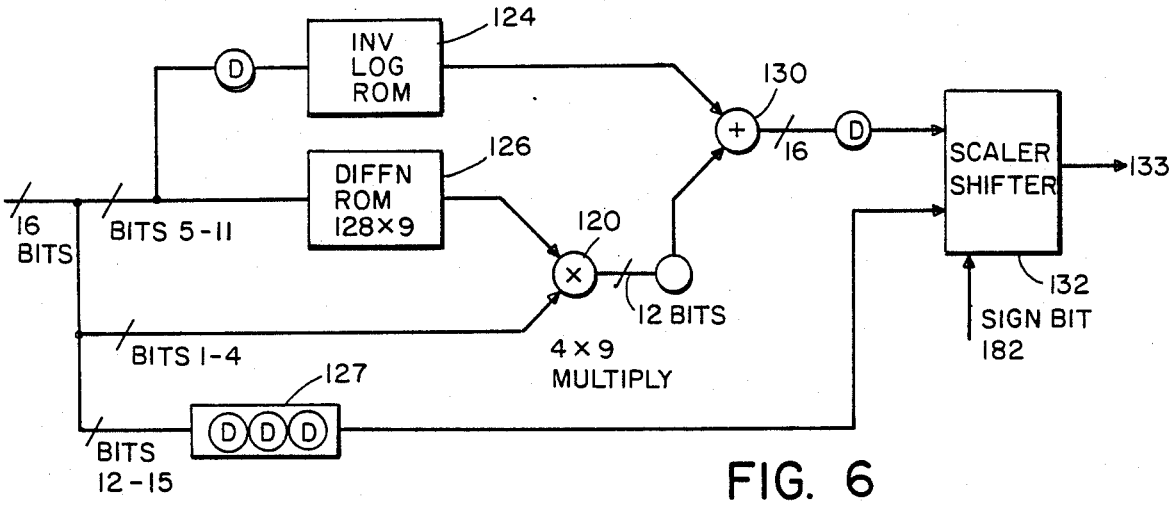

FIG. 6 details the inverse log ROM 125. The most significant 4 bits "12", "13", "14" and "15" are delayed and input to a scaling shifter 132 causing a possible 16 bit shift to a larger value depending upon the contents of the 4 most significant bits. The delayed sign bit, the MSB for the phase data latch 104, in FIG. 3, is input to the scaling shifter 132 changing the sign of the resulting output from the scaling shifter.

The operation of the inverse log ROM 124, difference ROM 126, and parallel multiplier 128, adder 130 and the clock delay latches are identical to that described previously in the log sine ROM 108 in FIG. 4.

Referring back to FIG. 3 and to FIGS. 7, 8, 8A, 8B and 9, the sum of all the possible 240 scaled partials, that is partials including amplitude envelopes, occurs at adder 134 and the accumulator 138 and is latched in the sample register 136. Signals from the bus interface logic 106 control proper operation within the DPC ensuring proper synchronization and prevention of spurious values from being entered into the sample register 136.

The sum of the scaled partials is 24 bits wide, however, the 4 MSB's are used in intermediate summing but, essentially, are in final output, and only twenty bits are input to the clipper 140. The clipper 140 outputs the sixteen most significant of the 20 bits and clamps the maximum value to FFFF in hex notation and the minimum value to 0000 in hex notation when over and underflow occurs. The four MSB's from the scaled partials from adder 134, are logically used by clipper 140 to determine overflow and underflow and to cause the clipper 140 to clamp its output. The loss of the four MSB's during very loud passages is not a problem but the loss of the four LSB's during very quiet passages in the present invention uses a technique of oversampling in conjunction with a Modulo-Sum Dither to lower quantization noise. The four LSB's output from the sample register 136 is input to adder 142, the adder 142 output is accumulated at four times the rate that sample sums are accumulated in the Modulo-Sum Dither (MSD) accumulator 144. Carry out 143 controls a one bit DAC component 172 of DAC system 38 (FIG. 8) implemented as a transistor and resistor whose output carries the average energy in the four LSB's of the original sample and this energy is summed with the output of the 16 bit DAC component 170 of DAC system 38 in the analog domain, by analog adder 171 and sample and hold circuit 176. The analog signal is processed by an anti-aliasing filter producing a signal for use, for example, by an audio amplifier driving speakers.

Figure 8:
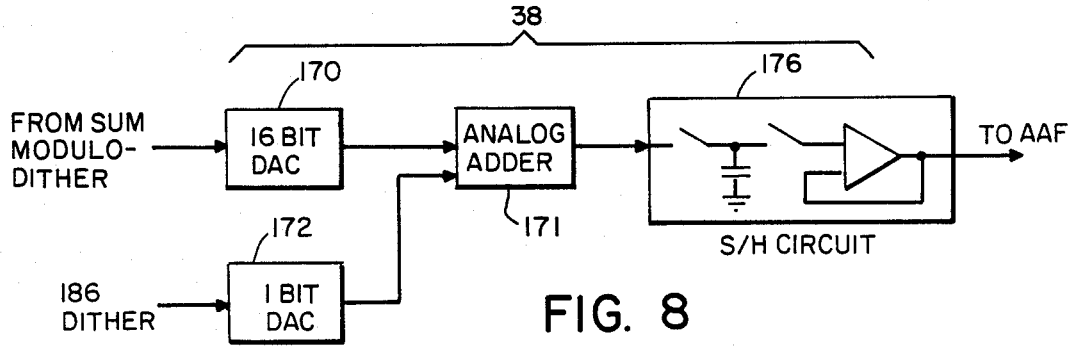
Figure 8A:
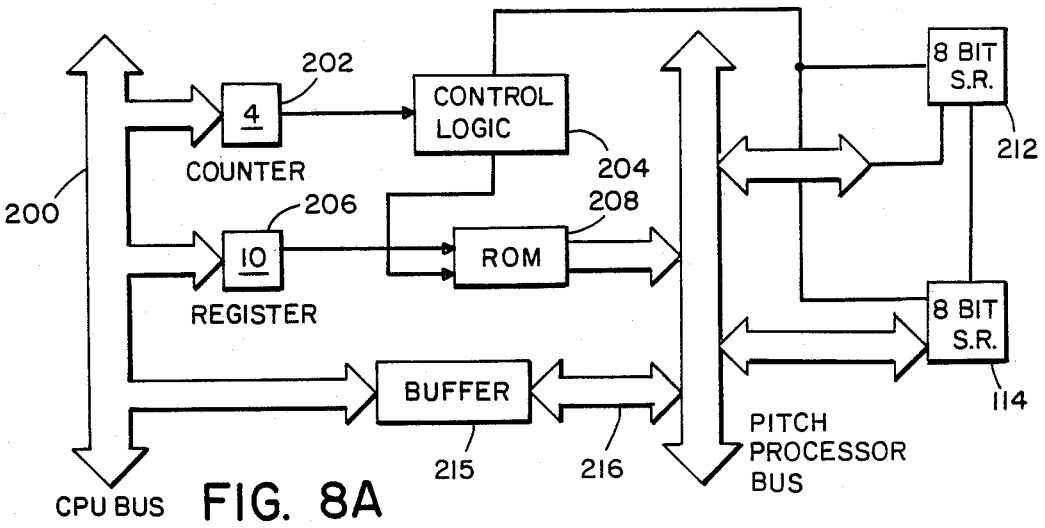
Figure 8B:
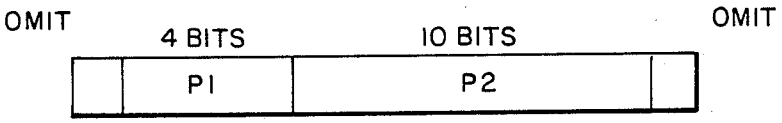

Characterization of a note being played includes not only a list of partials and an amplitude envelope, but a frequency or pitch envelope. "Pitch" denotes frequency on a logarithmic scale (corresponding to human perception). As an aid to the software's computation of frequencies (corresponding to pitches) the pitch processor hardware diagrammed in FIG. 8A is provided. The software must operate in the domain of logarithmically spaced pitches. The hardware comprises a log-to-linear converter for converting logarithmic pitch to linear frequency. FIG. 8A shows the handling of the conversion pursuant to the formula for f below and referring to the FIG. 8B showing of a pitch value. Ten bits (P2) are latched by digital latch 206 from the CPU bus as determined from the sound moddeling ROM 22, and simultaneously four bits (P1) are loaded into a four bit counter 202. P2 is a base 2-log mantissa controlling table look up and P1 is an integer base 2-log characteristic corresponding to a bit shift right.

$$f=f_o \cdot 2^{-[P/2048]}$$

Where P is relative pitch in units of 1/2048 octave on a scale where zero is D9 and increasing values correspond to decreasing frequency and where f and fo are in the engine's units of frequency ($5\times10^6/2^{24}$, i.e., approximately 0.29 Hz per unit), fo being 9397.273 Hz corresponding to 31532 of engine units.

The control logic guides the look up of the 10 bit mantissa from register 206 into the ROM 208 yielding a 16 bit frequency result on the pitch processor bus 216. This result is put on the bus 8 bits at a time loading sequentially into 8 bit shift registers 212 and 214. Once this is done the control object guides the bit shift right of the two registers, together, according to the count held in counter 202. The shifted number is retained in the shift register for later reads by the CPU on the CPU buss through buffer 215.

The DPC also has a duplicate of the sync counters

The DPC also has a duplicate of the sync counters contained in the PCC's and is able track of "dummy" partials by monitoring the global sync signal. This prevents spurious 1/10 transactions from being interpreted as valid partial data.

The one-bit modulo sum dither DAC is driven by modulo-sum dither logic imbedded in the DPC. This logic takes the unused four LSBs of the output sample and sends it to the modulo-sum accumulator, a four-bit accumulator operating at four times the sample clock rate. (See FIGS. 3–6). When the accumulators' carry out is set, corresponding to one LSB at the main DAC, the one-bit DAC is turned on. This causes the energy represented by the four LSBs to make its way into the final output.

This has the effect of decreasing the noise present in the audible portion of the spectrum while increasing it in the 20–40 KHz range, where it will be easily taken care of by the anti-imaging filter.

Figure 10:
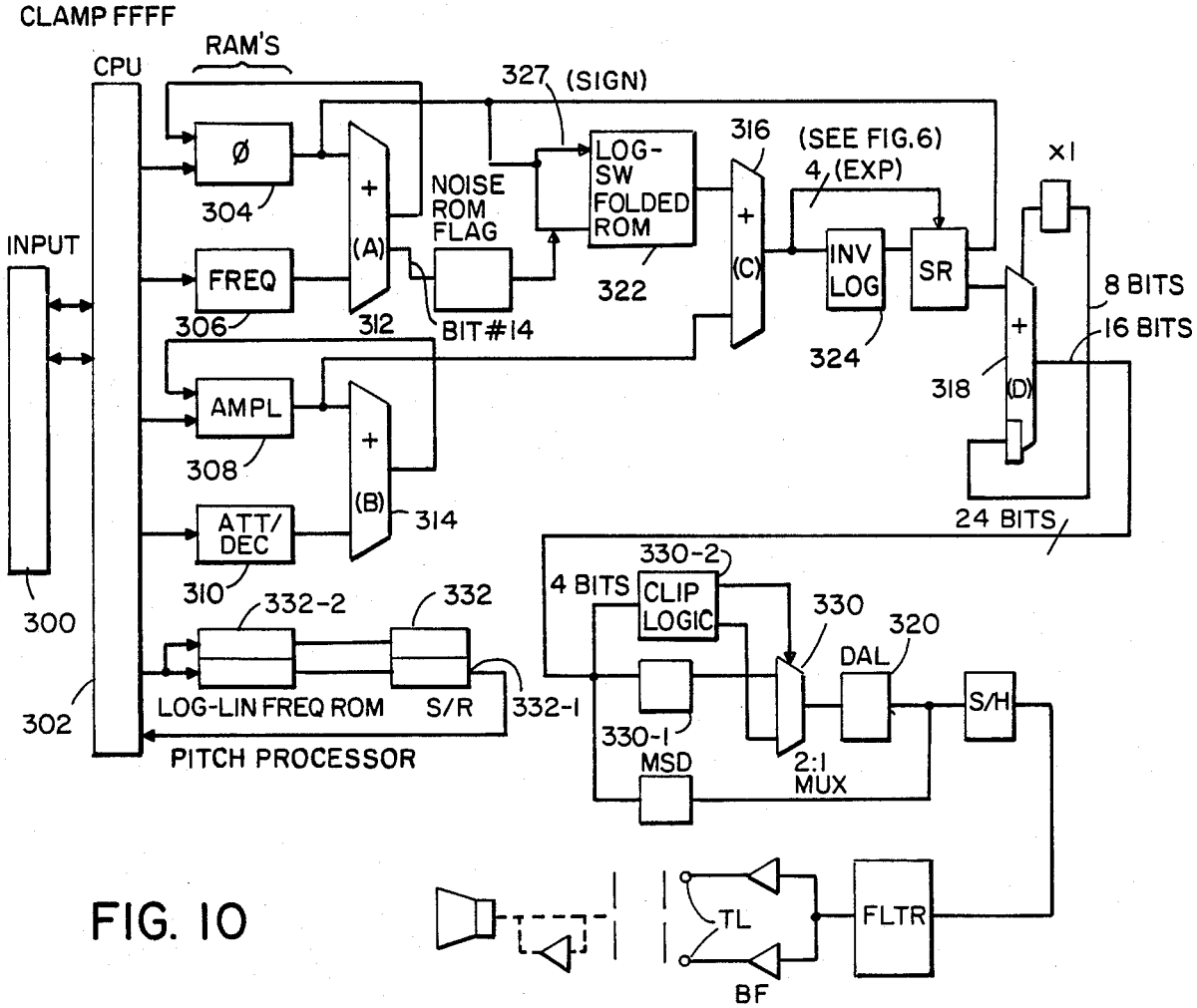

Referring now to FIG. 10 there is shown an embodiment of the invention comprising at 300, input means such as a keyboard, musical instrument digital interface or the like; at 302 a host processor incorporating a Motorola 68000 chip and related program ROM, RAM, timers and ROM for installed sounds (see FIG. 1) an interconnection device between the 16 bit bus and the 8 bit bus; at 304, 306, 308, 310, memory devices for, respectively, providing stored information of sine wave partials' phase (304), frequency (306), log of amplitude (308) and log of attack/decay rate data (310) in stored addresses corresponding (for 304 and 306) to eventual, log-sin, look-up table usage at ROM 322. The data output of 304 and 306 are added at 312, of 308 and 310 at 314. The output of 312, processed via log-sin noise ROM 322, and 314 is added at 316 to provide a sum for inverse log, at ROM 324. A combinatorial logic unit is provided at 326 to control the address complementing unit (folder) 327 which comprements addresses for second and fourth quadrants of sine wave cycles but does no complementing for noise partials. The adding is done by summing gate arrays 312(A) and 314(B) and that sum is processed via similar gate array adders 316(C) and 318(D) to a digtial analog converter (DAC) 320. The adders (B) (C) are clipped at over/under range and modulo sum dither is applied to the end product (out of (D) analogously to the system described above for the FIGS. 1–10 embodiment; D's output modification involves 1's complements adding. The form of clipping at (B) is sticking at max/min values while underflow is used at (C). The added sine wave partials converted to an analog output of the DAC is processed via conventional per se sample/hold (S/H), filter (FLTR), buffer (BF) equipment to headphone or other terminals (TL) and amplifier (AMP) and/or speaker (SPKR) components.

The logarithmic information is stored in a base-2 log convention to match oscillator frequency, sound range and computational needs.

While the above structure comprises the sound system for numerous voices, piano range is significantly provided with 32 kilobytes of stored information, compared to multi-megabyte order of magnitude storage for other synthesizers.

Piano-like random noise is imposed by a noise ROM 322 comprising two interleafed spectral sets of random noise; each set may be associated, selectively, with a particular partial. The noise spectra are originally obtained as random number sets. Fourier transforms are obtained, modified to match or nearly match desired noise spectra. Then inverses of such modified transforms are derived to provide time domain information at 223.

FIGS. 11–14 show the truncation or other structuring of 16 bit words using or ignoring specific end bits to leave a (10 to 16 bit) core of information used. Bit 15 is taken for sign information before (A) and bit 14 of the same word is taken for quadrant selection, the remaining 14 bits going to the log-sin ROM 322.

A clipped output amplitude level to the DAC 320 is established by a combined dither and clip hardware/-software including the adder 318 and accumulator elements X1, X2 thereof, a 2:1 MUX unit 330, holding register 330-1, and the modulo sum dither unit (MSD), as described above in connection with FIG. 7 above.

A baseline digital offset of minus (hexadecimal) 0801 from mid-range is used to avoid operation at the non linear cross-over point of the DAC.

A pitch processing unit 332, as described above enables the user's input via input means 300 and CPU 302 to call desired pitch information i.e., determining linear frequency increments (eventually to be fed to frequency processing RAM 306 from CPU 302).

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. Electronic musical instrument comprising in combination:

means defining a digitized waveform for utilization with multiple input parameter selections, means for making parameter selections via a user interface to generate digital inputs, means for generating logarithms of multiple parameters, adding the same and converting the sum to antilog equivalent and feeding back on itself to produce a sample sum and, means for applying the sample to output device and further comprising:

means for modulating the sample sum by clipping the bit length of each digital word thereof by clip rounding off the most significant bits, from an original n bit length, and further reducing into p bit length usable as a data unit by truncate-elimination of the most significant p bits of n.

* * * * *